US009961468B2

(12) United States Patent
Takeuchi et al.

(10) Patent No.: US 9,961,468 B2
(45) Date of Patent: May 1, 2018

(54) SOUND REPRODUCTION SYSTEMS

(75) Inventors: Takashi Takeuchi, Southampton (GB); Philip Arthur Nelson, Romsey (GB)

(73) Assignee: ADAPTIVE AUDIO LIMITED (GB)

( * ) Notice: Subject to any disclaimer, the term of this patent is extended or adjusted under 35 U.S.C. 154(b) by 861 days.

(21) Appl. No.: 12/667,342

(22) PCT Filed: Jul. 4, 2008

(86) PCT No.: PCT/GB2008/002310
§ 371 (c)(1),
(2), (4) Date: Apr. 15, 2010

(87) PCT Pub. No.: WO2009/004352
PCT Pub. Date: Jan. 8, 2009

(65) Prior Publication Data
US 2010/0202629 A1 Aug. 12, 2010

(30) Foreign Application Priority Data
Jul. 5, 2007 (GB) ..... 0712998.4

(51) Int. Cl.
*H04S 5/00* (2006.01)
*H04S 3/00* (2006.01)
*H04R 1/26* (2006.01)

(52) U.S. Cl.
CPC ..... *H04S 5/00* (2013.01); *H04R 1/26* (2013.01); *H04R 2205/024* (2013.01); (Continued)

(58) Field of Classification Search
CPC ... H04R 3/04; H04R 3/12; H04R 3/14; H04R 1/26; H04R 5/02; H04R 2205/024; (Continued)

(56) References Cited

U.S. PATENT DOCUMENTS 5,666,422 A * 9/1997 Harrison ..... H04R 5/04 381/1
5,764,777 A * 6/1998 Goldfarb ..... 381/27
2004/0096065 A1* 5/2004 Vaudrey et al. ..... 381/22

FOREIGN PATENT DOCUMENTS

WO 96/33591 10/1996
WO 02/01916 A2 1/2002

OTHER PUBLICATIONS

Takashi Tekeuchi et al., "Optimal source distribution system for virtual acoustic imaging", Audio Engineering Society, Convention Paper 5372 Presented at the 110th Convention, Amsterdam, The Netherlands, May 12-15, 2001.

* cited by examiner

*Primary Examiner* — Ping Lee
(74) *Attorney, Agent, or Firm* — Whiteford, Taylor & Preston, LLP; Peter J. Davis

(57) ABSTRACT

A sound reproduction system includes an electro-acoustic transducer and a transducer driver for driving the electro-acoustic transducer. The transducer drive includes a filter which is configured to reproduce at a listener's location an approximation to the local sound field that would be present at the listener's ears in recording space, taking into account the characteristics and intended position of the electro-acoustic transducer relative to the listener's ears. The electro-acoustic transducer includes a first sound emitter which provides an intermediate sound emission channel, and second and third sound emitters providing respective left and right sound emission channels. The first sound emitter is located intermediate of second and third sound emitters. Higher frequencies from at least one of the second and third sound emitters are transmitted closer to the first sound emitter while lower frequencies are transmitted away from the first sound emitter.

22 Claims, 33 Drawing Sheets

Discretised variable frequency/position transducer,

(52) U.S. Cl.
CPC ..... *H04S 3/002* (2013.01); *H04S 2400/05* (2013.01); *H04S 2420/01* (2013.01)

(58) Field of Classification Search
CPC . H04S 3/00; H04S 3/006; H04S 3/008; H04S 5/00; H04S 3/002; H04S 2420/01; H04S 240/05
USPC ..... 381/27, 1, 2, 300, 303–308, 98–100
See application file for complete search history.

Figure 1 - Block diagram for binaural reproduction over loudspeaker with system inversion,

Figure 2 - The geometry of a 2-source 2-receiver system under investigation,

Figure 3 - The definition of azimuth span,

Figure 4 - Norm and singular values of the inverse filter matrix H as a function of *n*. a) Linear scale, b) Logarithmic scale.

Figure 5 - Dynamic range loss due to system inversion,

Figure 6 - Condition number $\kappa(\mathbf{C})$ as a function of $n$,

Figure 7 – Sound radiation by the control transducer pairs with reference to the receiver directions (0 dB and -∞ dB).

Figure 8 – Principle of the OSD system,

Figure 9 - Relationship between source span and frequency for different odd integer number of $n$,

Figure 10 - Norm and singular values of the inverse filter matrix H of OSD as a function of frequency

Figure 11 – Sound radiation by the OSD transducer pairs with reference to the receiver directions (0 dB and -∞ dB).

Figure 12 - Singular values of the inverse filter matrix H as a function of *n*.
Optimal point for 2ch OSD and 3ch OSD

Figure 13 – Principle of the 3 channel OSD system,

Figure 14 - Relationship between source azimuth and frequency for different integer number of $n = 2,6,10, \ldots$

Figure 15 - Block diagram for binaural reproduction over 3 loudspeakers with system inversion,

Figure 16 - The geometry of a 3-source 2-receiver system under investigation,

Figure 17 - Norm and singular values of the inverse filter matrix H of the 3 channel case as a function of $n$. a) Linear scale, b) Logarithmic scale.

Figure 18 - Norm and singular values of the inverse filter matrix H of the 3 channel case as a function of *n*, when the sensitivity of the centre channel transducer is increased by a factor of 3dB. a) Linear scale, b) Logarithmic scale.

Figure 19 - Norm and singular values of the inverse filter matrix H of the 3 channel OSD as a function of frequency

Figure 20 - Variable frequency/position transducer,

Figure 21 – Discretised variable frequency/position transducer,

Figure 22 – An example of frequency/azimuth region and discretisation,

Figure 23 - Condition number κ(C) of the 3 channel case as a function of *n*.

Figure 24 - Condition number κ(C) of the 3 channel case as a function of *n*, when the sensitivity of the centre channel transducer is increased by a factor of 3dB.

Figure 25 – An example of inverse filters, cross-over network and transducers, (general)

Figure 26 – An example of inverse filters, cross-over network and transducers, (fullrange centre channel)

Figure 27 – An example of inverse filters, cross-over network and transducers, (inverse filters for each band)

Figure 28 – An example of inverse filters, cross-over network and transducers, (inverse filters for each band, cross-over before inverse filters)

Figure 29 – An example of inverse filters, cross-over network and transducers, (combination of 3ch OSD and 2ch OSD)

Figure 30 – An example of inverse filters, cross-over network and transducers, (combination of 3ch OSD and 2ch OSD, cross-over before inverse filters)

Figure 31 – An example of inverse filters, cross-over network and transducers, (combination of 2ch OSD and 3ch OSD)

Figure 32 – An example of inverse filters, cross-over network and transducers, (combination of 2ch OSD and 3ch OSD, cross-over before inverse filters)

SOUND REPRODUCTION SYSTEMS

CROSS-REFERENCE TO RELATED APPLICATIONS

This application is a US national stage application of PCT International Application No. PCT/GB2008/002310, filed Jul. 4, 2008, which designated the United States and has been published as International Publication No. WO 2009/004352 and on which priority is claimed under 35 U.S.C. § 120, and which claims the priority of British Patent Application No. GB 0712998.4, filed Jul. 5, 2007, pursuant to 35 U.S.C. 119(a) (d), the contents of which are incorporated herein by reference in their entirety as if fully set forth herein.

BACKGROUND OF THE INVENTION

This invention relates to sound reproduction systems.

The invention is particularly, but not exclusively, concerned with the stereophonic reproduction of sound whereby signals recorded at a plurality of points in the recording space such, for example, at the notional ear positions of a head, are reproduced in the listening space, by being replayed via three loudspeaker channels, the system being designed with the aim of synthesising at a plurality of points in the listening space an auditory effect obtaining at corresponding points in the recording space.

Binaural technology [1]-[3] is often used to present a virtual acoustic environment to a listener. The principle of this technology is to control the sound field at the listener's ears so that the reproduced sound field coincides with what would be produced when he is in the desired real sound field. One way of achieving this is to use a pair of loudspeakers (electro-acoustic transducers) at different positions in a listening space with the help of signal processing to ensure that appropriate binaural signals are obtained at the listener's ears [4]-[8].

It is also possible to use three channels of loudspeakers for binaural reproduction. It has been experimentally observed by several workers that the addition of another centre channel can improve the cross-talk cancellation achieved with two channel binaural reproduction systems. For example Miyoshi and Koizumi [9] presented a filter design technique for enhanced cross-talk cancellation when three loudspeakers are used in place of two loudspeakers, this method of design following from that previously presented by Miyoshi and Kaneda [10] for the inversion of room acoustic responses. A similar approach that used three loudspeakers was presented by Uto et al [11] who used an adaptive filter design technique. Finally Cooper and Bauck [12] also later disclosed a three channel filter design technique based on the analytical frequency domain inversion of the Moore-Penrose pseudo-inverse matrix of transfer functions relating the loudspeaker outputs to the listener ear signals.

We discuss hereafter in Section 2 a number of problems which arise from these conventional approaches to system inversion involved in such a binaural synthesis over loudspeakers. A basic analysis with a free field transfer function model illustrates the fundamental difficulties which such systems can have. The amplification required by the system inversion results in loss of dynamic range. The inverse filters obtained are likely to contain large errors around ill-conditioned frequencies. Regularisation is often used to design practical filters but this also results in poor control performance. The performance suffers severely even with small errors in the reproduction stage. The Optimal Source Distribution (OSD) provided the solution for all the above problems by introducing the concept of variable frequency span transducers [13].

SUMMARY OF THE INVENTION

A sound reproduction system comprising electro-acoustic transducer means, and transducer drive means for driving the electro-acoustic transducer means in response to a plurality of channels of a sound recording, the transducer drive means comprising filter means which is configured to reproduce at a listener location an approximation to the local sound field that would be present at a listener's ears in recording space, taking into account the characteristics and intended position of the electro-acoustic transducer means relative to the ears of the listener, the electro-acoustic transducer means comprising first sound emitter means which provides an intermediate sound emission channel, second sound emitter means which provides a left sound emission channel and a third sound emitter means which provides a right sound emission channel, the first sound emitter means being located intermediate of second and third sound emitter means, the second and third sound emitter means being such that predominantly higher frequencies are transmitted closer to the first sound emitter means and predominantly lower frequencies are transmitted away from the first sound emitter means.

In a preferred embodiment of the invention we provide three channels of sound emitter means that are each positioned in a different azimuthal region relative to a listener location, and portions of each of the second and third sound emitter means having different azimuth directions emit different frequencies or different frequency ranges of sound.

The sound emitters may be in the form of discrete side-by-side/adjacent transducer units, each unit being substantially in the form of a conventional loudspeaker. For example each transducer unit may emit sound at predominant frequency or range of frequencies, or each unit may comprise a plurality of transducer sub-assemblies each of which emits a respective predominant frequency or range of frequencies. Alternatively the sound emitters may be constituted by area portions of an extended transducer means. Thus, the position of the emitter portions of the extended transducer could be arranged to vary continuously with frequency.

It should be appreciated that the invention does not preclude the use of additional electro-acoustic transducer means such as one or more sub-woofer units or one or more conventional loudspeakers for stereophonic or surround reproduction.

Preferably the operational transducer position-frequency range for the left and right channel of emitters is determined by $$\theta_L = \arcsin\left(\frac{n\pi}{2k\Delta r}\right) = \arcsin\left(\frac{nc_0}{4\Delta r f}\right) \tag{a}$$

$$\text{that is, } f = \frac{nc_0}{4\Delta r \sin\theta_L} \tag{b}$$

$$\theta_R = \arcsin\left(\frac{n\pi}{2k\Delta r}\right) = \arcsin\left(\frac{nc_0}{4\Delta r f}\right) \tag{c}$$

$$\text{that is, } f = \frac{nc_0}{4\Delta r \sin\theta_R} \tag{d}$$

where $\theta_L$, and $\theta_R$ are the azimuth span with respect to the listener subtended by the left and centre, and right and centre channel emitters respectively, where $0<n<4$.

$c_0$: speed of sound (≈340 m/s)

$\Delta r$: equivalent distance between the ears

The following equation is the correction factor to the foregoing equations (a), (b), (c) and (d) which are obtained from free field model, in order to match the frequency-azimuth characteristics to the realistic case with the presence of head diffraction.

$$\Delta r=\Delta r_0(1+(\theta_L+\theta_R)/\pi)$$

$\Delta r_0$: distance between the ears (≈0.12~0.25 m)

Note that signal levels to define the operational frequency-span range should ideally be monitored at the receiver positions, not at the transducer input or output signals. This is because there may be a relatively large output signal level outside the operational frequency range for a transducer pair (much smaller than it would be without cross-over filters but may be larger compared to the case of multi-way conventional stereo reproduction without system inversion) which will cancel each other due to the characteristics of the plant matrix that results in small signal level at the ears.

In the foregoing equation (a) n being made equal substantially to 2 is ideal, and a 'tolerance' of ±2 for example can be applied to produce a position-frequency range. Thus n=2 can be assigned to around the centre frequency of the desired frequency range.

In one advantageous embodiment we employ $0<n<3.9$.

In another advantageous embodiment we employ $0<n<3.7$.

In yet another advantageous embodiment we employ $0.1<n<3.9$.

In a further advantageous embodiment we employ $0.3<n<3.7$.

An example of a 2-way system will now be described. Cross-over filters may be employed for distributing signals over the appropriate frequency range to the appropriate sound emitters. The cross-over filters may be arranged to respond to the outputs of an inverse filter means ($H_h$, $H_1$) of said filter means. Alternatively inverse filter means ($H_h$, $H_1$) of said filter means may be arranged to be responsive to the outputs ($d_h$, $d_1$) of the cross-over filters.

The filter means may be configured to be a minimum norm solution of the inverse problem.

The filter means may be configured to be a pseudoinverse filter.

The filter means may be configured to be adaptive filters.

The filter means may be configured to apply regularisation to the drive output signals in a frequency range at the lower end of the audio range.

Sub-woofers may be provided for responding to very low audio frequencies.

When the sound emitters are constituted by area portions of an extended transducer means, the extended transducer means preferably comprises elongated sound emitting members, the sound emitting surfaces of each member having a proximal end and a distal end, the proximal ends of the left and right channel transducers being adjacent to centre channel, excitation means mounted on said members adjacent to said proximal ends for imparting vibrations to said members in response to the drive output signals, the vibration transmission characteristics of the members being chosen such that the propagation of higher frequency vibrations along the members towards the distal end is inhibited whereby the proximal end of said surfaces is caused to vibrate at higher frequencies than the distal end.

According to another aspect of the invention there is provided electro-acoustic transducer arrangement comprising a first sound emitter which provides an intermediate sound emission channel, a second sound emitter which provides a left sound emission channel and a third sound emitter which provides a right sound emission channel, the first sound emitter being located intermediate of second and third sound emitter, and at least one of the second and third sound emitters being such that predominantly higher frequencies are transmitted closer to the first sound emitter and predominantly lower frequencies are transmitted away from the first sound emitter.

Yet a further aspect of the invention relates to a transducer drive for driving an electro-acoustic transducer arrangement in response to a plurality of channels of a sound recording, the transducer drive comprising a filter arrangement which is configured to reproduce at a listener location an approximation to the local sound field that would be present at a listener's ears in recording space, taking into account the characteristics and intended position of the electro-acoustic transducer arrangement relative to the ears of the listener, the transducer drive configured for use the electro-acoustic transducer arrangement which comprises a first sound emitter which provides an intermediate sound emission channel, a second sound emitter which provides a left sound emission channel and a third sound emitter which provides a right sound emission channel, the first sound emitter being located intermediate of second and third sound emitter, and at least one of the second and third sound emitters being such that predominantly higher frequencies are transmitted closer to the first sound emitter and predominantly lower frequencies are transmitted away from the first sound emitter.

Where the transducer drive comprises a configurable signal processor, machine-readable instructions may be used to suitably configure the transducer drive. The instructions may be provided on a data carrier, such as a CD or DVD, or may be in the form of a signal or data structure

BRIEF DESCRIPTION OF THE DRAWINGS

Various embodiments of the invention will now be described, by way of example only, together with a more detailed presentation of prior art arrangements with reference to the accompanying drawings, which show.

DETAILED DESCRIPTION OF EXEMPLARY EMBODIMENTS

Figure 1:
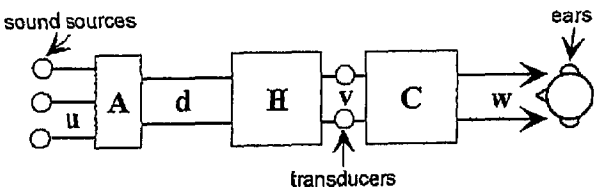
FIG. 1—Block diagram for binaural reproduction over loudspeaker with system inversion, FIG. 2—The geometry of a 2-source 2-receiver system under investigation, FIG. 3—The definition of azimuth span, FIG. 4—Norm and singular values of the inverse filter matrix H as a function of n. a) Logarithmic scale. b) Linear scale, FIG. 5—Dynamic range loss due to system inversion, FIG. 6—Condition number $\kappa(C)$ as a function of n, FIG. 7—Sound radiation by the control transducer pairs with reference to the receiver directions (0 dB and −∞ dB).

The principle of binaural reproduction over loudspeaker is described below and is illustrated in FIG. 1. The objective of the system is to feed to each ear of the listener independently the binaural signals that contain auditory spatial information as well as the signals associated with sources in a virtual sound environment. However, when loudspeakers are used for this purpose, each loudspeaker feeds its signal to both ears. There is a matrix of acoustic paths between the loudspeakers and the listener's ears, and this can be expressed as a matrix of transfer functions (plant matrix). Independent control of two signals (such as the binaural sound signals) at two receivers (such as the ears of a listener) can be achieved with two electro-acoustic transducers (such as loudspeakers), by filtering the input signals to the transducers with the inverse of the transfer function matrix of the plant. This process is also referred to as system inversion or cross-talk cancellation. The signals and transfer functions involved are defined as follows. Two monopole transducers produce source strengths (volume accelerations) defined by the elements of the complex vector $v=[v_1(j\omega)v_2(j\omega)]^T$. The resulting acoustic pressure signals are given by the elements of the vector $w=[w_1(j\omega)w_2(j\omega)]^T$. This is given by $$w=Cv \tag{1}$$

where C is the plant matrix (a matrix of transfer functions between sources and receivers). The two signals to be synthesised at the receivers are defined by the elements of the complex vector $d=[d_1(j\omega)d_2(j\omega)]^T$. In the case of audio applications, these signals are usually the signals that would produce a desired virtual auditory sensation when fed to the two ears independently. They can be obtained, for example, by recording sound source signals u with a recording head (eg a dummy head) or by filtering the signals u by matrix of synthesised binaural filters A.

Therefore, a filter matrix H which contains inverse filters is introduced (the inverse filter matrix) so that v=Hd where $$H=\begin{bmatrix} H_{11}(j\omega) & H_{12}(j\omega) \\ H_{21}(j\omega) & H_{22}(j\omega) \end{bmatrix} \tag{2}$$

and thus $$w=CHd \tag{3}$$

The inverse filter matrix H can be designed so that the vector w is a good approximation to the vector d with a certain delay [14][15]. When the independent control at two receivers is perfect, CH becomes the identity matrix I. The inverse filter matrix H can also be designed to be a pseudo-inverse of the plant matrix C. The filter matrix H can also consist of adaptive filters.

Figure 2:
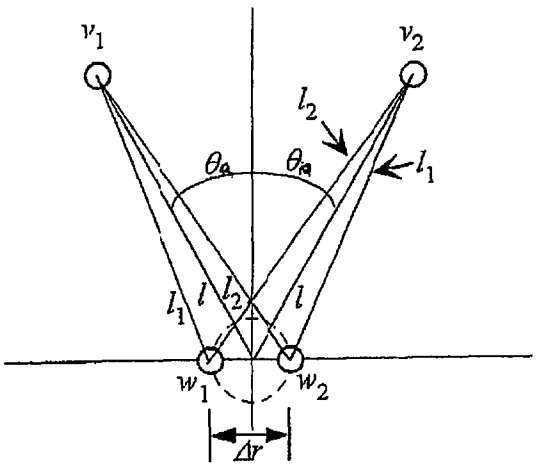
Figure 3:
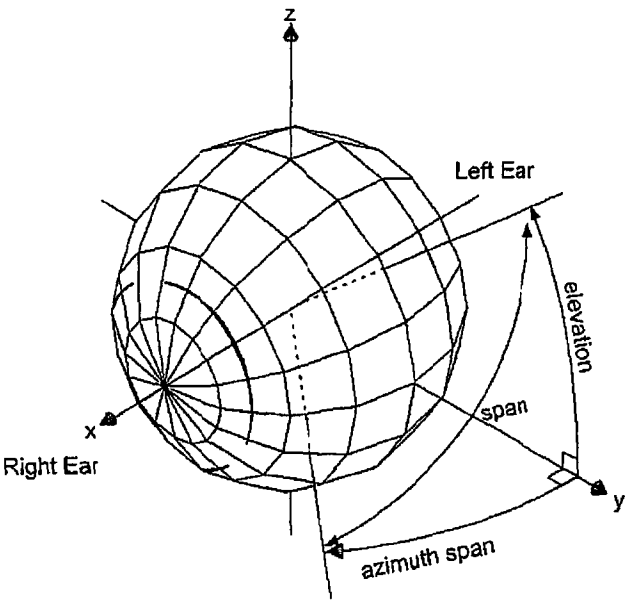

However, the system inversion involved gives rise to a number of problems such as, for example, loss of dynamic range and sensitivity to errors. A simple case involving the control of two monopole receivers with two monopole transducers (sources) under free field conditions is first considered here. The fundamental problems with regard to system inversion can be illustrated in this simple case. The geometry is illustrated in FIG. 2. Note that θ is a difference of azimuth (azimuth span), not the actual span (FIG. 3).

In the free field case, the plant transfer function matrix can be modelled as $$C=\frac{\rho_0}{4\pi}\begin{bmatrix} e^{-jkl_1}/l_1 & e^{-jkl_2}/l_2 \\ e^{-jkl_2}/l_2 & e^{-jkl_1}/l_1 \end{bmatrix} \tag{4}$$

where an $e^{j\omega t}$ time dependence is assumed with $k=\omega/c_0$, and where $\rho_0$ and $c_0$ are the density and sound speed.

Now consider the case $$d=\frac{\rho_0 e^{-jkl_1}}{4\pi l_1}\begin{bmatrix} D_1(j\omega) \\ D_2(j\omega) \end{bmatrix} \tag{5}$$

i.e., the desired signals are the acoustic pressure signals which would have been produced by the closer sound source and whose values are either $D_1(j\omega)$ or $D_2(j\omega)$ without disturbance due to the other source (cross-talk). This way the effect of system inversion can be separated from the effects of spherical attenuation due to propagation in space as well as ensuring a causal solution. The elements of H can be obtained from the exact inverse of C, and the magnitude of the elements of H ($|H_{mn}(j\omega)|$) show the necessary amplification of the desired signals produced by each inverse filter in H. The maximum amplification of the source strengths can be found from the 2-norm of H (denoted as ||H||) which is the largest of the singular values of H, where these singular values are denoted by $\sigma_o$ and $\sigma_i$ [13]. Thus $$\|H\|=\max(\sigma_o,\sigma_i) \tag{6}$$

Figure 4:
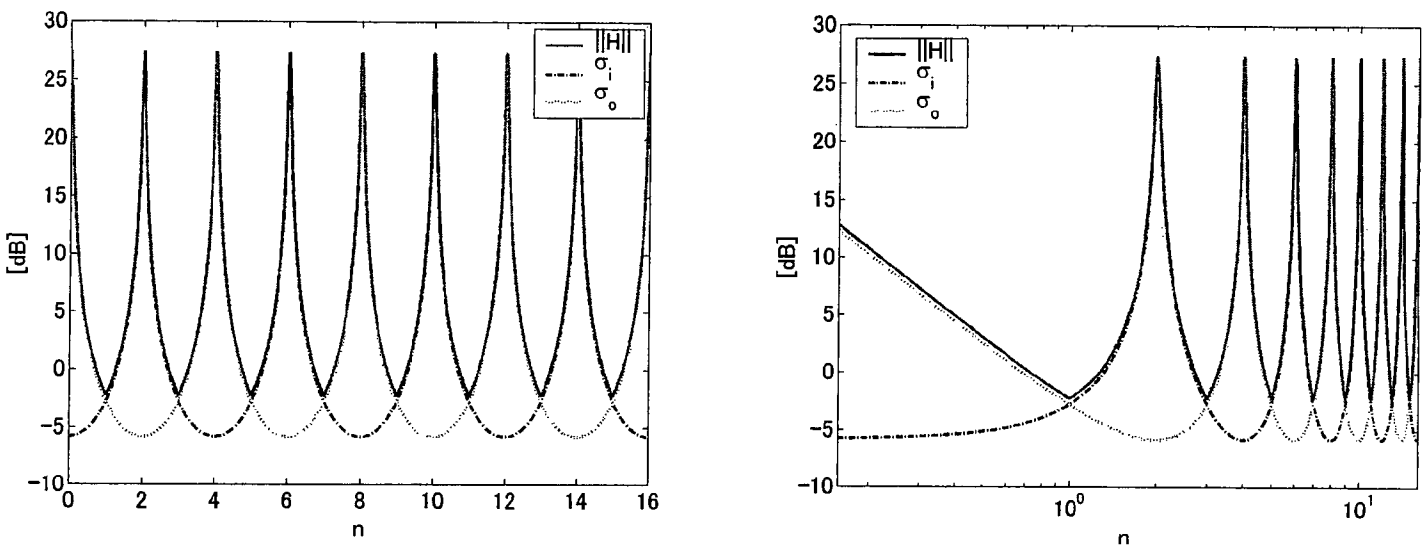
Figure 5:
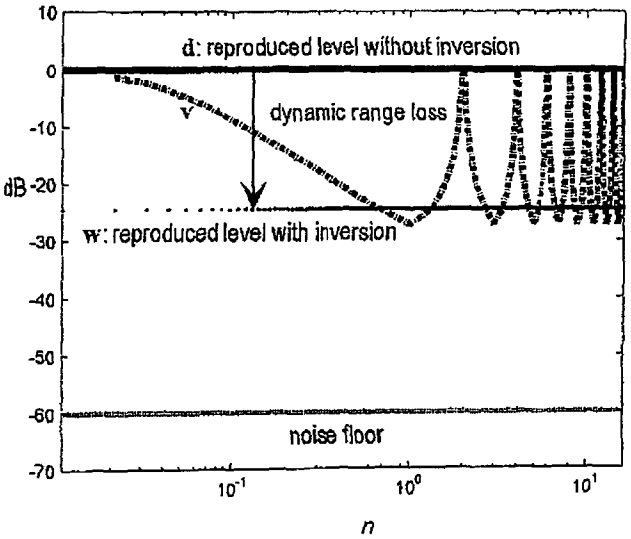

$\sigma_o$ corresponds to the amplification factor of the out-of-phase component of the desired signals and $\sigma_i$ corresponds to the amplification factor of the in-phase component of the desired signals. Plots of $\sigma_o$, $\sigma_i$, and ||H|| with respect to frequency are illustrated in FIG. 4. As seen in FIG. 4, ||H|| changes periodically and has peaks where k and θ satisfy the following relationship with even values of the integer number n.

$$k\Delta r\sin\theta = \frac{n\pi}{2} \tag{7}$$

The singular value $\sigma_o$ has peaks at n=0, 4, 8, . . . where the system has difficulty in reproducing the out-of-phase component of the desired signals and $\sigma_i$ has peaks at n=2, 6, 10, . . . where the system has difficulty in reproducing the in-phase component. Around these frequencies, sound signals from control sources interfere destructively with each other, leaving little response left at the ears of the listener. In other words, the signals cancel each other. Therefore, the solution for the inverse, i.e., the amplification required to produce the desired sound pressure at each receiver, becomes substantially large.

FUNDAMENTAL PROBLEMS OF PRIOR ART SYSTEMS BEFORE OPTIMAL SOURCE DISTRIBUTION

3.1 Loss of Dynamic Range

In practice, since the maximum source output is given by $\|H\|_{max}$, this must be within the range of the system in order to avoid clipping of the signals. The required amplification results directly in the loss of dynamic range illustrated in output levels and dynamic range of the systems are the same. Where ||H|| is large, each transducer is emitting very large sound most of which is cancelled by the sound from the other transducers. As a result, the levels of synthesised binaural signals at the listener's ears are significantly smaller than that those without cancellation. The given dynamic range is distributed into the system inversion and the remaining dynamic range that is to be used by the binaural auditory space synthesis, and also most importantly, by the sound source signal itself. Thus the signal to noise ratio of the signals w becomes low. Since the transducers are working much harder than they would normally to produce usual sound levels at the ears, non-linear distortion becomes more significant and is often audible. For the same reason, fatigue of the transducers is more severe. Conventional driver units are not designed to be used in this manner and they can be easily destroyed by fatigue.

Eq. (1) implies that the system inversion (which determines v and leads to the design of the filter matrix H) is very sensitive to small errors in the assumed plant C (which is often measured and thus small errors are inevitable) where the condition number of C, κ(C), is large. In addition, the reproduced signals w are less robust to small changes in the real plant matrix C, where κ(C) is large.

Figure 6:
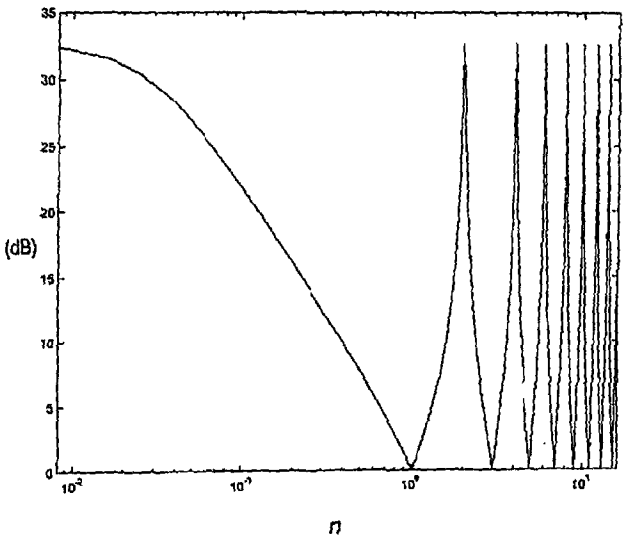

The condition number of C is shown in FIG. 6. As seen in FIG. 6, κ(C) has peaks where Eq. (7) is satisfied with an even value of the integer number n. The frequencies which give peaks of κ(C) are consistent with those which give the peaks of ||H||.

The calculated inverse filter matrix H is likely to contain large errors due to small errors in the assumed plant matrix C and results in large errors in the reproduced signal w at the receiver. This is because such errors are magnified by the inverse filters but remain not being cancelled in the plant. Even if H does not contain any errors, the reproduction of the signals at the receiver is too sensitive to the small errors within the real plant matrix C to be useful.

Such errors include individual differences of HRTFs, [16]-[18] and misalignment of the head and loudspeakers [19], approximation of filters and regularisation, where a small error is deliberately introduced to improve the condition of matrix to design practical filters [20]. These errors may seem small but it is far too large in practice where κ(C) is large.

On the contrary, κ(C) is small around the frequencies where n is an odd integer number in Eq. (7). Around these frequencies, a practical and close to ideal inverse filter matrix H is easily obtained and the accurate reproduction of intended sound signal is possible.

Figure 7:
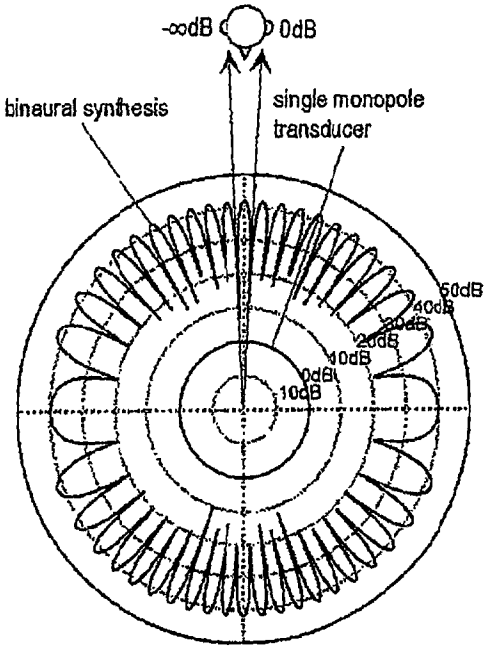

FIG. 7 shows an example (n≈2) of far field sound radiation by the control transducers with reference to the receiver directions. The horizontal axis is the inter-source axis and the receivers (ears) are close to the direction of the vertical axis. At frequencies where Eq. (7) is not satisfied with an odd value of the integer number n, as in this example, the sound radiation in directions other than receiver directions can be significantly larger (typically +30 dB~40 dB) than those at the receiver directions (0 dB and −∞ dB). When the environment is not anechoic, as is normally the case, this obviously results in severe reflection. Reflections from surrounding objects (e.g., furniture, walls, floors, and ceilings) affect the control performance. Although the perceptual aspects of sound localization such as the precedence effect suggest that the performance of this kind of system will be retained to some extent [21], reflected sound with a much higher level than the controlled sound arriving directly at the listener's ears destroys the correct perception.

In addition, the sound radiated in directions other than that of receiver has a peaky frequency response due to the response of inverse filter matrix H and normally results in severe coloration. This contributes to coloured reverberation and makes listening in any other location other than one optimal location impractical.

Equation (7) can be rewritten in terms of the source azimuth span Θ as $$\Theta = 2\theta = 2\arcsin\left(\frac{n\pi}{2k\Delta r}\right) \tag{8}$$

As seen from the analysis above, frequencies with the source span where n is an odd integer number in Eq. (8) give the best control performance as well as robustness.

Figure 8:
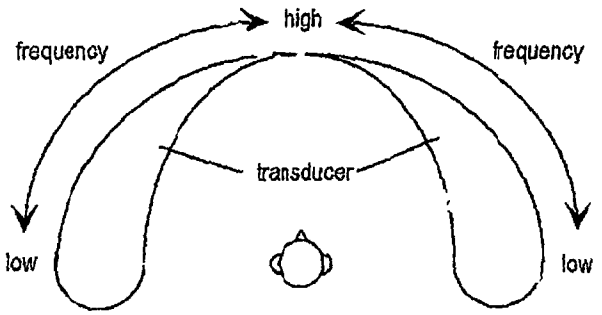
FIG. 8—Principle of the OSD system.
Figure 9:
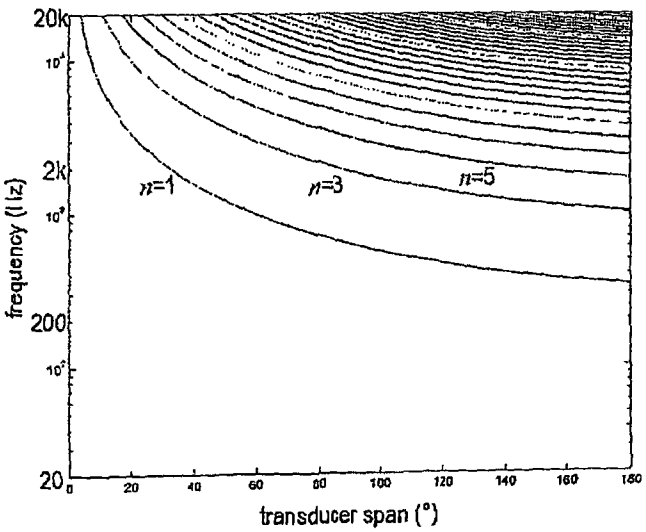
FIG. 9—Relationship between source span and frequency for different odd integer number n, FIG. 10—Norm and singular values of the inverse filter matrix H of OSD as a function of frequency, FIG. 11—Sound radiation by the OSD transducer pairs with reference to the receiver directions (0 dB and −∞ dB).
Figure 10:
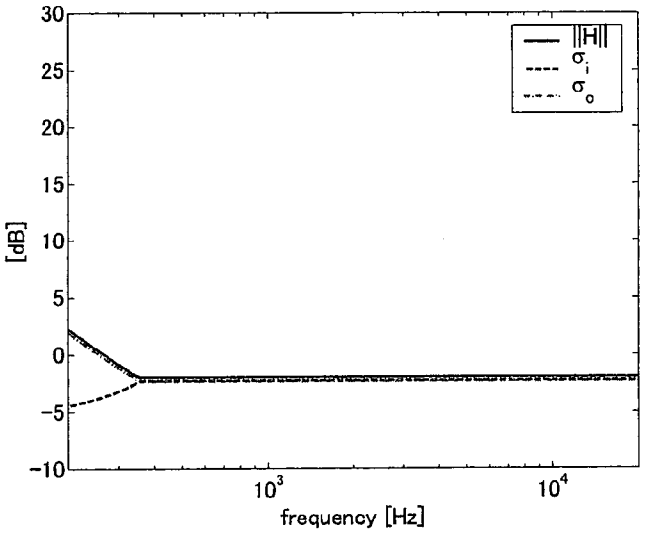
Figure 11:
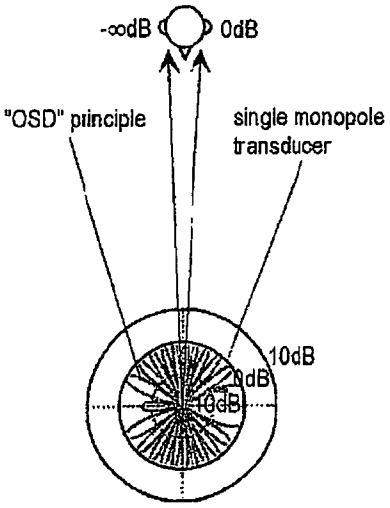

The Optimal Source Distribution (OSD) introduced the idea of a pair of conceptual monopole transducers whose span varies continuously as a function of frequency (FIG. 8) in order to satisfy the requirement for n to be an odd integer number in Eq. (8) (FIG. 9) at all frequencies (except at very low frequencies) [15]. This relationship is where $\sigma_i$ and $\sigma_o$ are balanced and the source span becomes smaller as frequency becomes higher. With this concept, the frequency response of the inverse filter becomes flat for all frequencies as shown in FIG. 10. Therefore, there is no dynamic range loss compared to the case without system inversion. This means the system has good signal to noise ratio and the advantage of reduced distortion or fatigue of transducers. The inverse filters have a flat frequency response so there is no coloration at any location in the listening room even outside the intended listening position. When the listener is far away from the intended listening position, the spatial information perceived may not be ideal. However, the spectrum of the sound signals is not changed by the inverse filters. Therefore, the listener can still enjoy the natural production of sound together with some remaining spatial aspects, especially the aspects for which the spectral information is important. As shown in FIG. 11, the sound radiation by the transducer pair in all directions is always smaller than those in the receiver directions, which is also smaller than the sound radiation by a single monopole transducer producing the same sound level at the ears. In contrast to FIG. 7, the system does not radiate excessive sound all around so it is also robust to reflections in a reverberant environment, and these small reflections do not have any coloration other than that caused by the reflecting materials. Note also that $\kappa(C)=1$ which is constant over all frequencies and which is the smallest possible value [13]. The error in calculating the inverse filter is small and the system has very good control over the reproduced signals. The system is also very robust to the changes in plant matrix.

As discussed above, the two-channel OSD essentially uses the frequency span region where the two singular values, representing the in-phase and out-of-phase components of the binaural reproduction process, are balanced in order to overcome the fundamental problems of conventional binaural reproduction over loudspeakers. However, a system which aims to improve this further is proposed in what follows. For convenience, we refer to it as the "three channel OSD" system in contrast to the earlier OSD that will henceforth be referred as the "two channel OSD".

Figure 12:
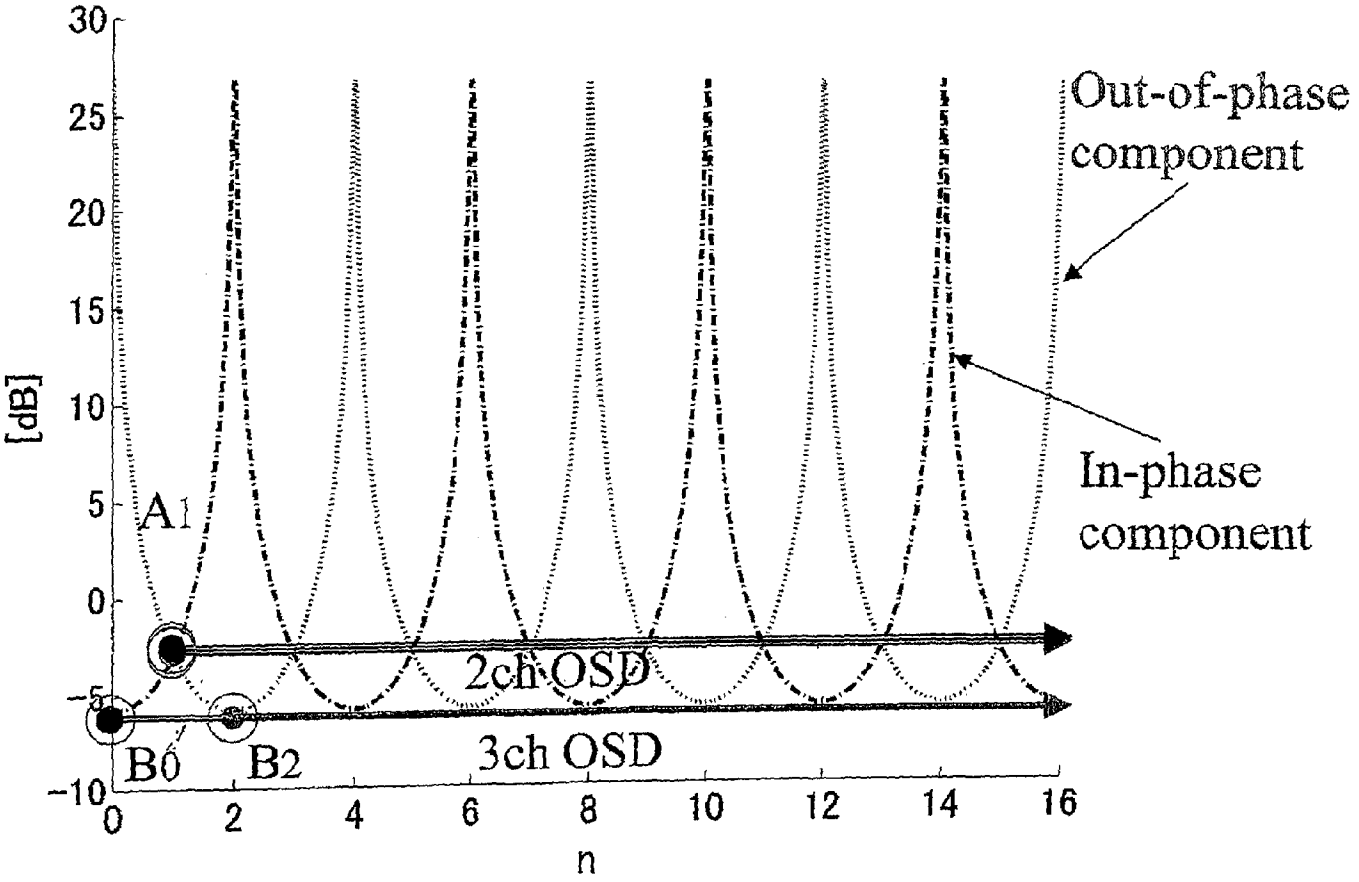
FIG. 12—Singular values of the inverse filter matrix H as a function of n. Optimal point for 2 channel OSD and 3 channel OSD FIG. 13—Principle of the 3 channel OSD system, FIG. 14—Relationship between source span and frequency for different integer number of n=2, 6, 10, . . . .
Figure 13:
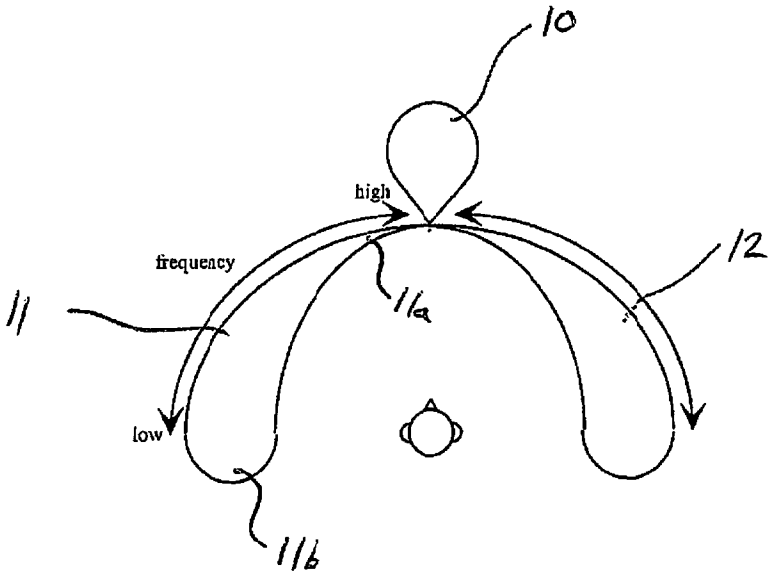

Now we try to make use of the lowest value (−6 dB, at points B in FIG. 12) of each of the two singular values, rather than where two singular values are balanced at −3 dB (at points A in FIG. 12). When the azimuth span of two transducers becomes 0, the lowest value of the singular values $\sigma_i$ is given. In other words, there is one transducer in the median plane. (FIG. 13). This may be viewed as in effect the addition of a third transducer for the binaural reproduction over loudspeakers. When the third transducer is added around the median plane of the listener, we have found that this can relax the condition for the in-phase component significantly, since this should give in effect the lowest singular value over the entire frequency range. With specific reference to FIG. 13 there is provided a first transducer 10 which provides a central channel, a second transducer 11 which provides a left channel and a third transducer which provides a right channel. As is shown schematically in FIG. 13 each of second and third transducers extends over a particular azimuthal directions and at positions progressively closer to the first transducer 10 predominantly higher frequencies are emitted. So, at distal end portion 11*b* the lowest frequencies are predominantly emitted whereas at the proximal end portion 11*a* predominantly the highest frequencies are emitted. From the listener's perspective the first transducer 10 is positioned intermediate of the second transducer 11 and the third transducer 12.

Figure 14:
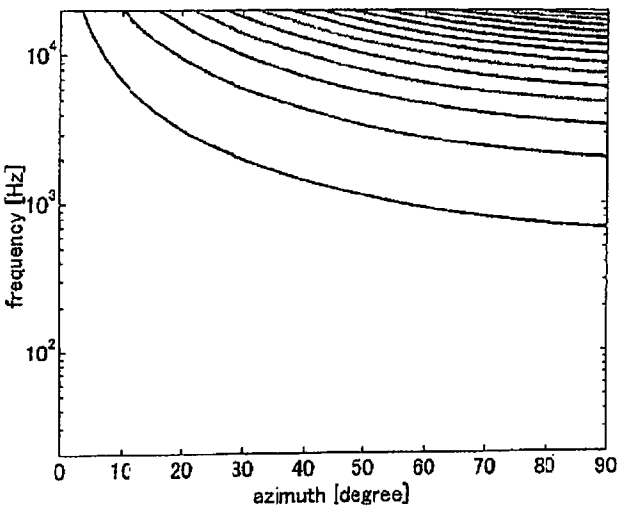

Since the condition for the in-phase component has now been relaxed, we now can use the optimal value (points B in FIG. 12) for the singular value $\sigma_o$, the out-of-phase component, rather than compromised (balanced) point between $\sigma_o$ and $\sigma_i$ which is the optimal combination of the singular values for two channel OSD. The lowest value of $\sigma_o$ is given at n=2, 6, 10, . . . . Therefore, the three channel OSD makes use of one of the points B, and stretches the point over entire the frequency range above it by introducing the idea of conceptual monopole transducers whose position varies continuously as a function of frequency, satisfying the requirement for n=2, 6, 10, . . . in Eq. (8) (FIG. 14) at all frequencies except very low frequencies. This is in contrast to the two channel OSD in which one of points A (where n=1, 3, 5, . . . ) is stretched over the entire frequency range.

Figure 15:
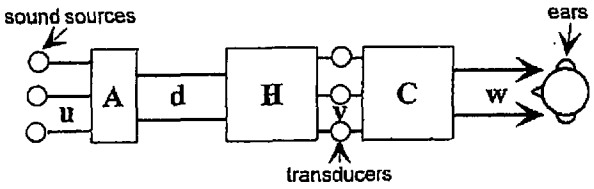
FIG. 15—Block diagram for binaural reproduction over 3 loudspeakers with system inversion, FIG. 16—The geometry of a 3-source 2-receiver system under investigation, FIG. 17—Norm and singular values of the inverse filter matrix H of the 3 channel case as a function of n. a) Logarithmic scale. b) Linear scale, FIG. 18—Norm and singular values of the inverse filter matrix H of the 3 channel case as a function of n when the sensitivity of the centre channel transducer is increased by a factor of 3 dB. a) Logarithmic scale. b) Linear scale, FIG. 19—Norm and singular values of the inverse filter matrix H of the 3 channel OSD as a function of frequency FIG. 20—Variable frequency/position transducer, FIG. 21—Discretised variable frequency/position transducer, FIG. 22—An example of frequency/azimuth region and discretisation, FIG. 23—Condition number κ(C) of the 3 channel case as a function of n, FIG. 24—Condition number κ(C) of the 3 channel case as a function of n, when the sensitivity of the centre channel transducer is increased by a factor of 3 dB.
Figure 16:
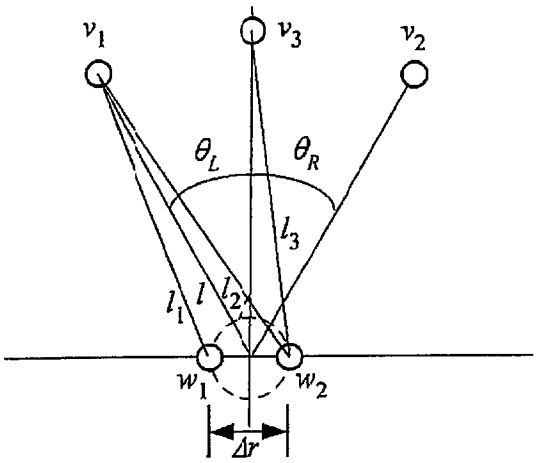

In order to see the effect of this additional transducer, we consider the simple case again where monopole transducers are used for binaural reproduction as in section 2.2 but this time with another transducer added on the median plane. The block diagram and geometry are illustrated in FIG. 15 and FIG. 16. Eq. 4 becomes $$C = \frac{\rho_0}{4\pi}\begin{bmatrix} e^{-jkl_1}/l_1 & e^{-jkl_3}/l_3 & e^{-jkl_2}/l_2 \\ e^{-jkl_2}/l_2 & e^{-jkl_3}/l_3 & e^{-jkl_1}/l_1 \end{bmatrix} \tag{10}$$

where an $e^{j\omega t}$ time dependence is assumed with $k=\omega c_0$, and where $\rho_0$ and $c_0$ are the density and sound speed.

Note that the system is under-determined in that there can be a number of choices of the inverse filter matrix which produces no error [22] [23]. Among them, the minimum norm solution would be the most straightforward choice as well as giving the best performance with regard to the fundamental problems described in Section 3.1~3.3. Therefore, the following examples use the minimum norm solution.

Figure 17:
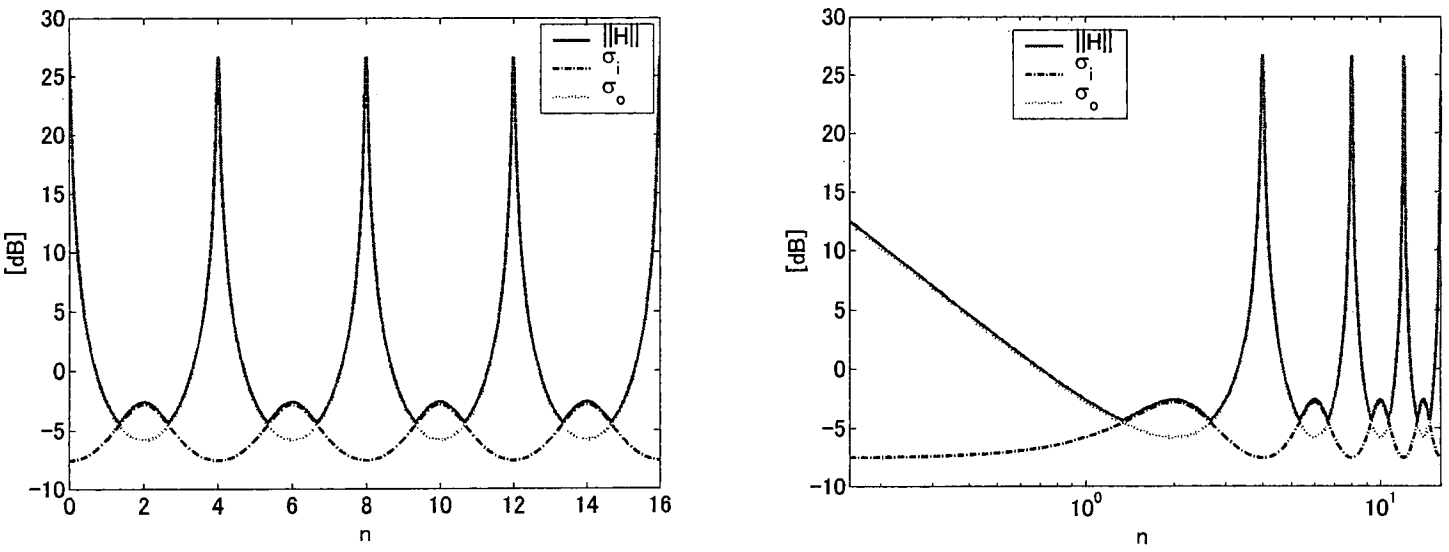

The 2-norm of H (‖H‖) and the two singular values $\sigma_o$ and $\sigma_i$ with respect to frequency are illustrated in FIG. 17. Compared with FIG. 4, the peaks of the singular value $\sigma_i$ at n=2, 6, 10, . . . where the system has difficulty in reproducing the in-phase component, have almost disappeared in FIG. 17. The level difference of about 3 dB between the values of $\sigma_i$ and $\sigma_o$ at n=2, 6, 10, . . . is due to the fact that two transducers can work on reproducing the out-of-phase component of the binaural signal whereas there is only one transducer available for the in phase component.

Figure 18:
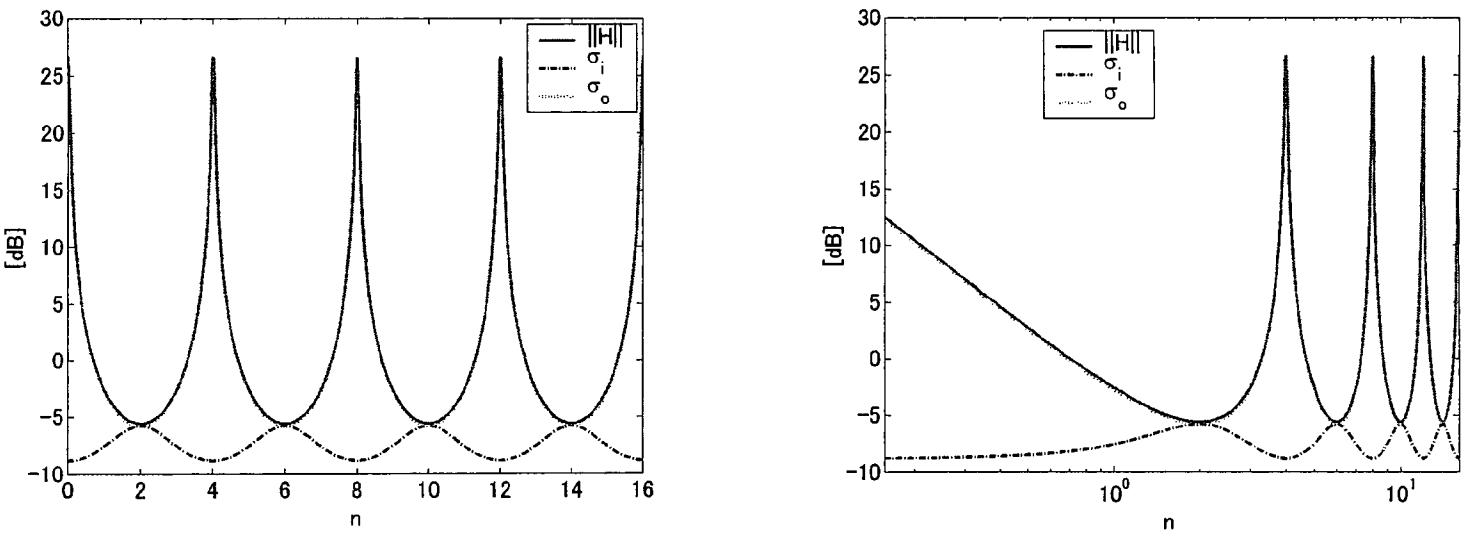

Having a third transducer for two point reproduction (i.e the mathematically under-determined case), the balance between the two singular values $\sigma_o$ and $\sigma_i$ can be changed independently by changing the relative sensitivity of the transducer of the centre channel with respect to those on the left and right. This is an important aspect which the three channel OSD possesses which in contrast the two channel OSD does not. If the sensitivity of the centre channel transducer is increased by the factor of $\sqrt{2}$, the two singular values $\sigma_o$ and $\sigma_i$ become equal to each other at n=2, 6, 10, . . . and that is shown in FIG. 18.

Figure 19:
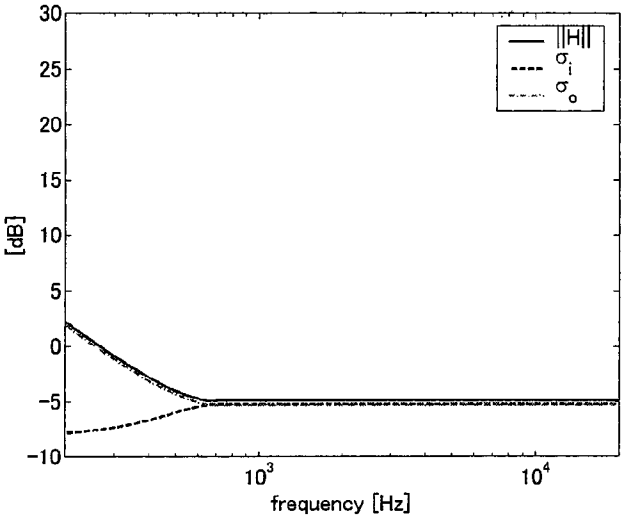

The singular value $\sigma_i$ at n=0, 4, 8, . . . is always smaller than that of at n=2, 6, 10, . . . where all three transducers can contribute to the reproduction of in phase component. The 2-norm of H (‖H‖) and the two singular values $\sigma_o$ and $\sigma_i$ of the 3 channel OSD with respect to frequency are illustrated in FIG. 19.

Figure 20:
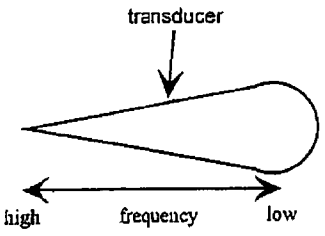

The three channel OSD requires, for the transmission of the left and right channels, monopole type transducers whose position varies substantially continuously as frequency varies, similar to the case with the two channel OSD. This may, for example, be realised by exciting a substantially triangular shaped plate whose width varies along its length. The requirement of such a transducer is that a certain frequency or a certain range of frequencies of vibration is excited most at a particular position having a certain width such that sound of that frequency is radiated mostly from that position (FIG. 20). The centre channel can either be a conventional monopole transducer which emits all the frequency components of the sound from one point. Alternatively the same type of transducer as the left and right channel can also be used to provide the centre channel as well.

From Eq. (7), the range of source direction is given by the frequency range of interest as can be seen from FIG. 14. A smaller value of n gives a smaller source azimuth for the same frequency. Therefore, the smallest source azimuth $\theta_h$ for the same high frequency limit is given by n=2 and this is about ±4° to give control of the sound field at two positions separated by the distance between two ears (about 0.13 m for KEMAR dummy head) up to a frequency of 20 kHz.

Eq. (7) can also be rewritten in terms of frequency as $$f = \frac{nc_0}{4\Delta r \sin\theta} \tag{11}$$

The smallest value of n gives the lowest frequency limit for a given source direction. Since sin θ≤1, $$f \geq \frac{nc_0}{4\Delta r} \tag{12}$$

ie, the physically maximum source azimuth of $\theta_L=\theta_R=90°$ gives the low frequency limit, $f_1$, associated with this principle. A smaller value of n gives a lower low frequency limit so the system given by n=2 is normally the most useful among those with n=2, 6, 10, . . . . The low frequency limit given by n=2 of a system designed for all average human is about $f_l$=700 Hz, which is higher than that for two channel OSD where it is about 350 Hz. Below the low frequency limit of three channel OSD, the performance gradually approaches that of two channel OSD, becoming identical below the low frequency limit of two channel OSD.

In FIG. 17 and FIG. 18, the slope of the singular values around the ideal frequency/azimuth line are a lot shallower, forming a U shaped valley rather than a V shaped valley in the case of two channels shown in FIG. 4. This means the three channel OSD is much more robust to errors than the two channel OSD.

The fundamental behaviour is the same for the more realistic case where various other factors such as the Head Related Transfer Function come into effect as in the case with the two channel OSD.

The discretisation of the Optimal Source Distribution can also be used for the three channel OSD in a similar way to the two channel case. In practice, whilst a monopole transducer whose position varies continuously as a function of frequency may not be easily available it is possible to realize a practical system based on the underlying principle by discretising the transducer span. With a given span, the frequency region where the amplification is relatively small and plant matrix C is well conditioned is relatively wide around the optimal frequency.

Figure 21:
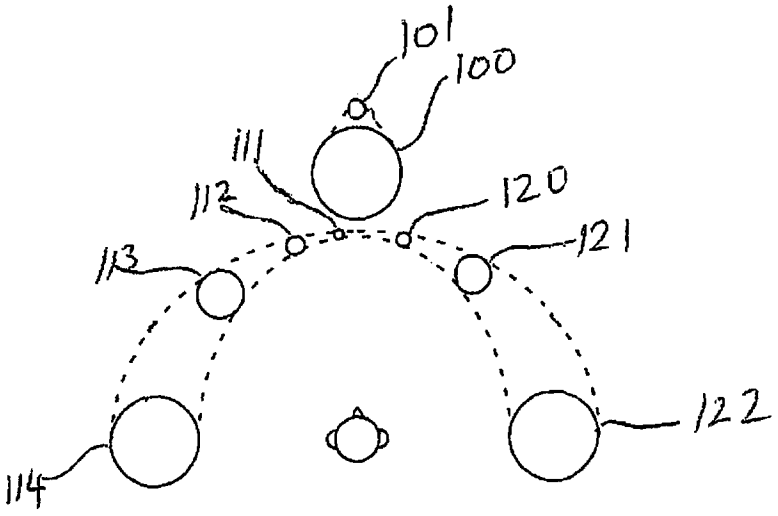
Figure 22:
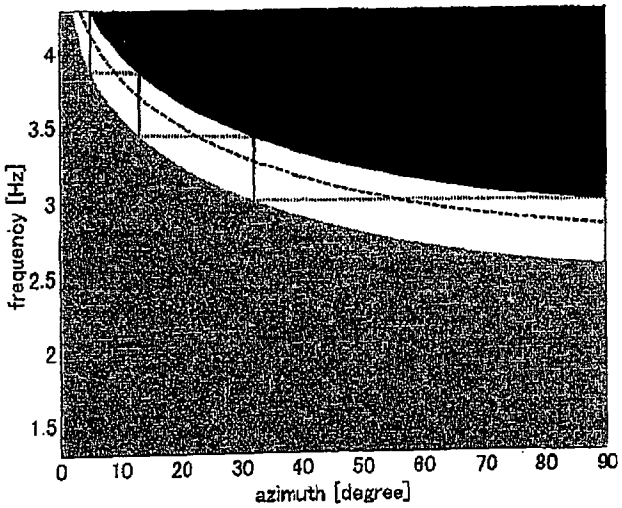

Therefore, by allowing n to have some width, say ±ν (0<ν<2), a certain transducer span can nevertheless be allocated to cover a certain range of frequencies where control performance and robustness of the system is still reasonably good (FIG. 22). Consequently, it is possible to discretise the continuously varying transducer position into a finite number of discrete transducer positions, and at each position there is provided a transducer unit. With reference to FIG. 21 there is shown a possible realisation of discretised arrangement in which transducers 111, 112, 113 and 114 provide a left channel, transducers 120, 121, and 123 provide a right channel and transducers 100 and 101 provide an intermediate channel. Each of the transducers forming the left channel emit a predominant frequency, or a predominant frequency band, in respect of frequencies which increase the closer a particular transducer is to the transducer forming the intermediate channel. The transducers forming the right channel are arranged in similar fashion. As is evident from FIG. 21, implementation of an embodiment of the invention need not necessary require that equal numbers of transducer units are required for each of right and left channels.

The difference of the slope around the ideal frequency/span relationship has advantages here again in many ways. For the same given tolerance width of n, the error will be much smaller than that in the two channel OSD. So the same level of discretisation gives a better approximation to the ideal case for the three channel OSD. For the same level of approximation, the discretisation can be coarser hence saving resources. The maximum width of n, which is the maximum allowance for ν, becomes twice that in the two channel OSD, i.e. 0<ν<2. In general, the performance of the discretised three channel OSD is much better due to the fact that the valley in FIG. 17 and FIG. 18 is U shaped rather than V shaped.

Figure 23:
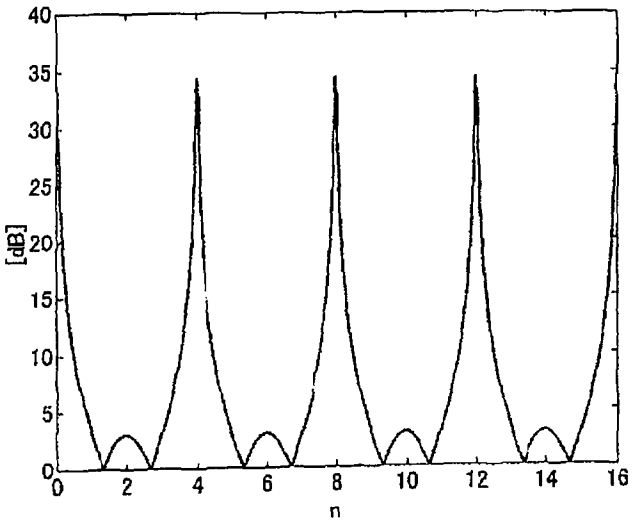
Figure 24:
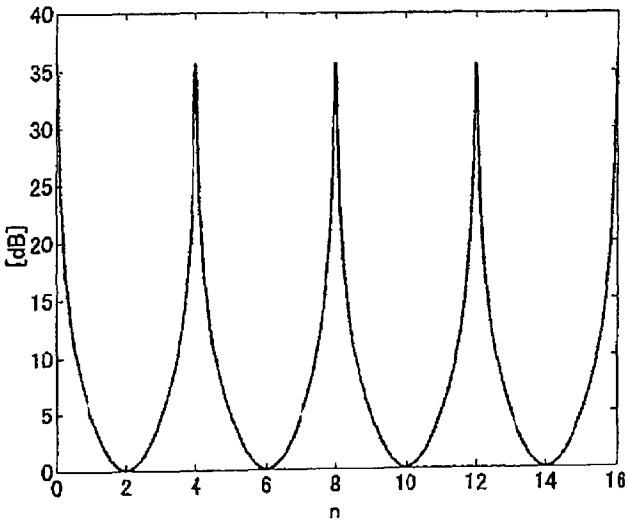

The condition number for the case shown in FIG. 17 and FIG. 18 is plotted in FIG. 23 and FIG. 24 respectively. The condition number is smaller in FIG. 24 than in FIG. 23 around the ideal frequency/azimuth region. On the other hand, The case shown in FIG. 23 could have a smaller maximum condition number over the operational frequency/azimuth region when ν is larger than 1. These characteristics may be taken into consideration when the discretised three channel OSD is derived from them.

Reference will now be made to FIGS. 25 to 32 which show various further realisations of sound reproduction systems embodying the three channel OSD arrangement.

Figure 25:
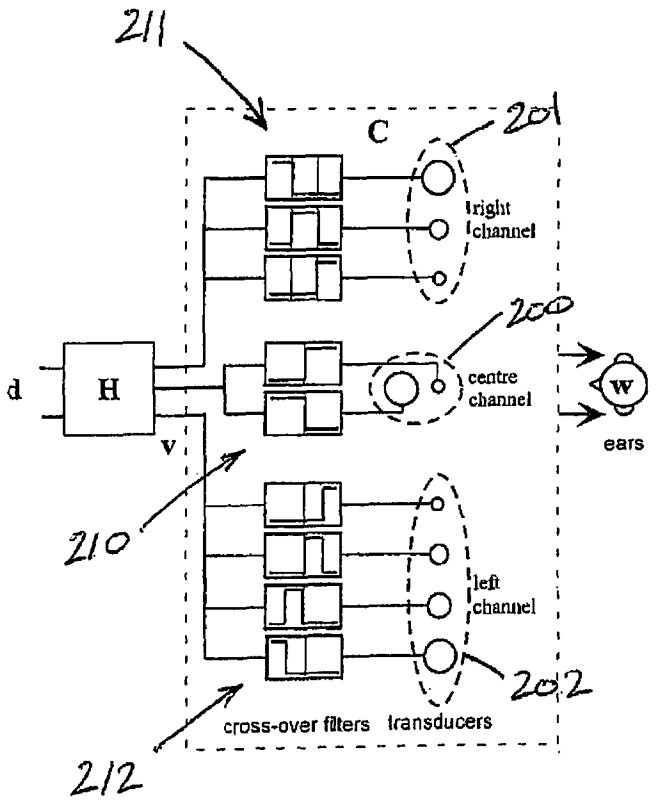
FIGS. 25 to 33 show schematic representations of various sound reproduction systems embodying the three channel OSD arrangement.

Turning initially to FIG. 25, this shows one way to realise the arrangement of FIG. 21, in which each transducer of each channel arrangement 200, 201 and 202 is connected to a respective cross-over filter of a respective cross-over filter arrangement 210, 211 and 212.

Figure 26:
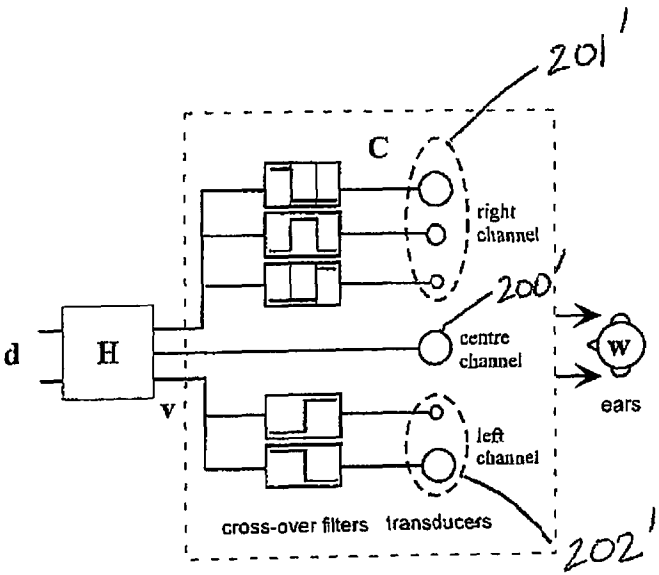

FIG. 26 shows a variant embodiment of that shown in FIG. 25 in which the centre channel 200' is provided by a single full range transducer. Furthermore the left channel 202' is provided now with a reduced number of transducers, namely two transducers. It will be appreciated however that each of the left and right channel could include any number of transducers.

Figure 27:
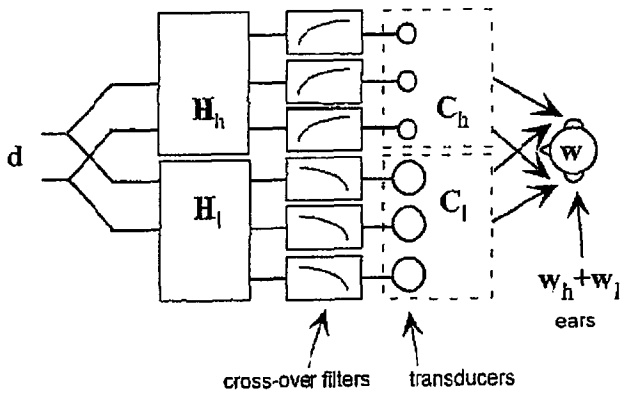

FIG. 27 shows a three channel OSD arrangement in which an inverse filter, $H_h$ and $H_1$ is provided for each band $C_h$ and $C_1$. In this arrangement one of each of a high frequency transducer and a lower frequency transducer is provided for each of the left channel, the right channel and the central channel.

Figure 28:
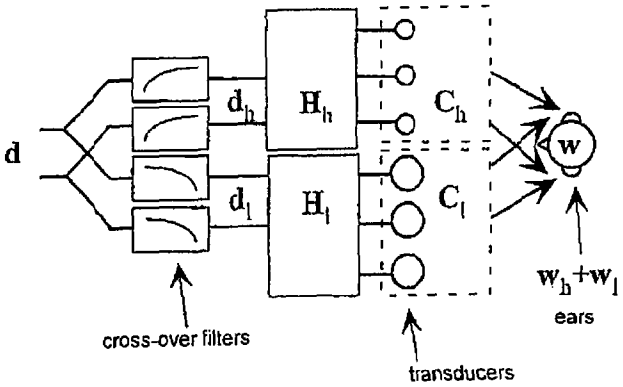

FIG. 28 is a variant embodiment to that shown in FIG. 27 in which cross-over filtering is effected before inverse filtering is effected.

Figure 29:
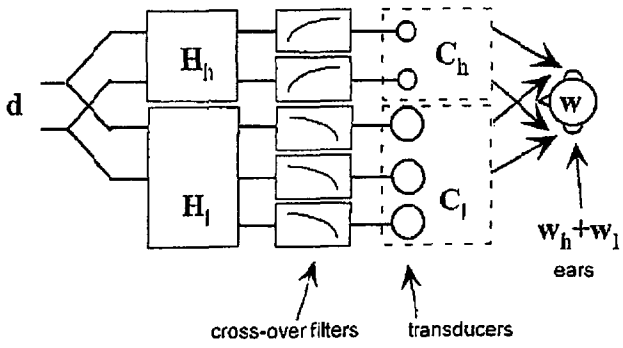

FIG. 29 shows an arrangement which may be viewed as a combination of the three channel OSD and the known two channel OSD, resulting in the system having unequal numbers of channels for each frequency band.

Figure 30:
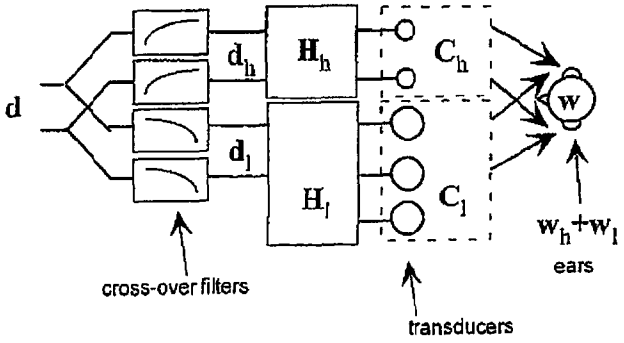

FIG. 30 is a variant of the arrangement of FIG. 29 in which cross-over filtering is effected before inverse filtering.

Figure 31:
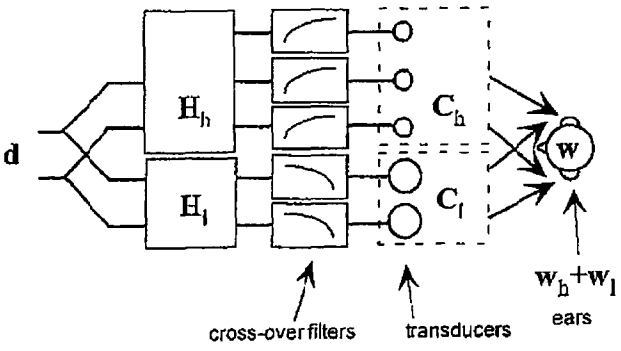

FIG. 31 is an arrangement similar to that of FIG. 29 in which three high frequency transducers and two low frequency transducers are provided.

Figure 32:
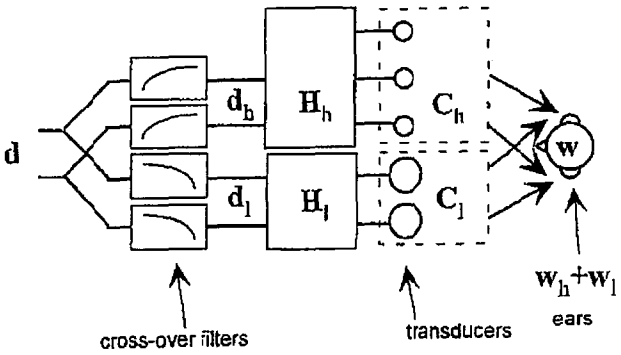

FIG. 32 is a variant embodiment of that shown in FIG. 31 in which cross-over filtering is effected before inverse filtering.

Figure 33:
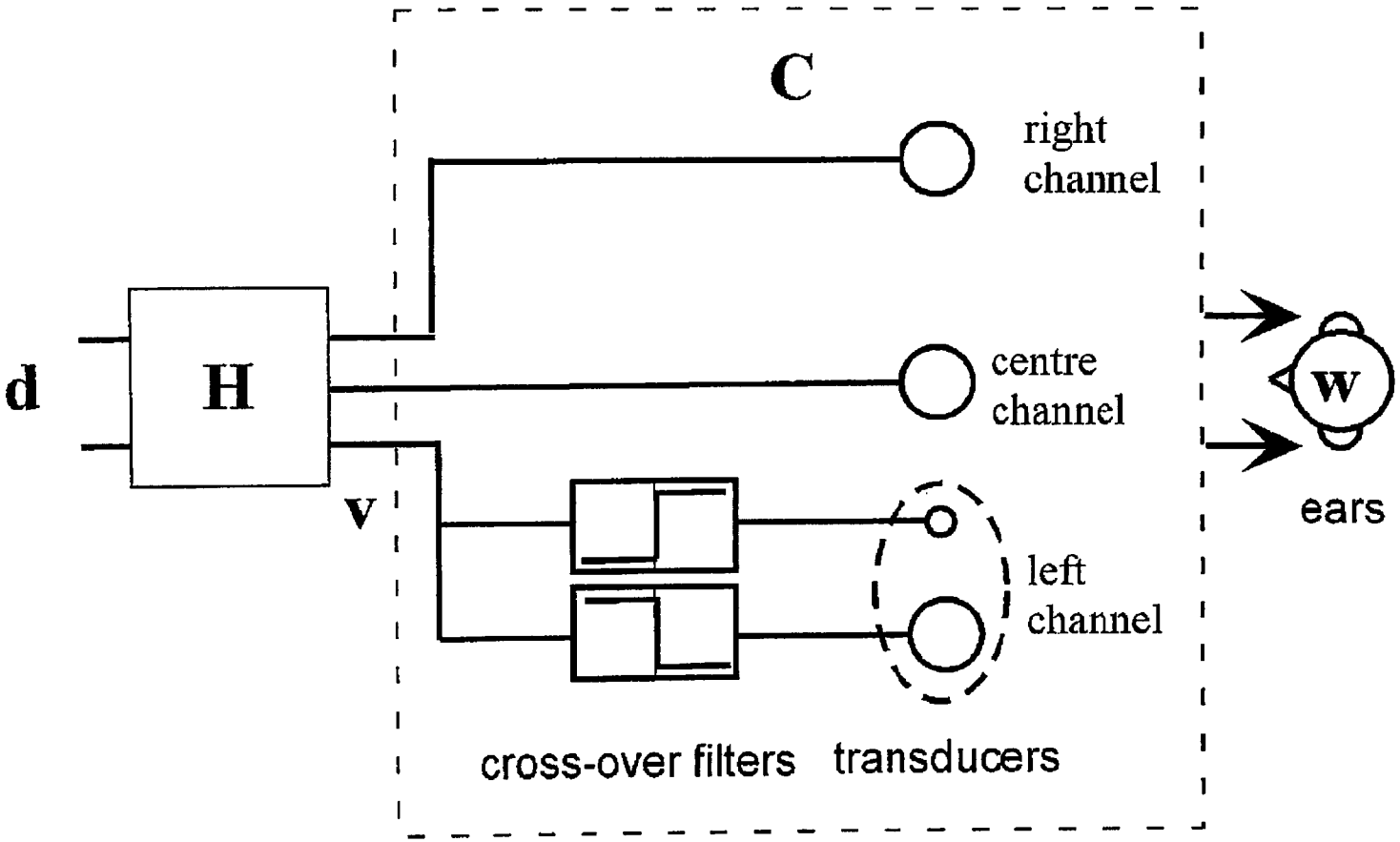

With reference to FIG. 33 there is shown yet a further embodiment in which the centre channel and the right channel transducers each emit the entire frequency range from substantially the same (respective) location. For the left channel however higher frequencies are emitted closer to the central channel transducer and lower frequencies are emitted further away from the central channel transducer. In a variant of this embodiment the transducer arrangement of the right channel is replaced by the transducer arrangement of the left channel of FIG. 33, and the transducer arrangement of the left channel is replaced by the transducer arrangement of the right channel of FIG. 33.

A new binaural reproduction system has been described which overcomes the fundamental problems with system inversion by utilising three-channels of transducers with variable position with respect to frequency.

This system can most easily be realised in practice by discretising the theoretical continuously variable transducer span which results in multi-way sound control system.

The three channel OSD arrangement finds application in numerous ways and in particular in the field of home audio. A particularly advantageous implementation is in the context of the transducers of portable media devices, such as mobile telephones and portable gaming devices, and so enhances the listener's experience of sound emitted thereby. Some portable media devices (such as MP3 players) are capable of being interfaced with a separate speaker arrangement (sometimes known as a docking station). Such speaker arrangements would benefit from being adapted to implement the three channel OSD arrangement.

REFERENCES

[1] J. Blauert, Spatial Hearing; The Psychophysics of Human Sound Localization (MIT Press, Cambridge, Mass., 1997).

[2]H. Møller, "Fundamentals of Binaural Technology," Appl. Acoust. 36, 171-218 (1992).

[3] D. R. Begault, 3-D Sound for Virtual Reality and Multimedia (AP Professional, Cambridge, Mass., 1994).

[4] M. R. Schroeder, B. S. Atal, "Computer Simulation of Sound Transmission in Rooms," IEEE Intercon. Rec. Pt7, 150-155 (1963).

[5] P. Damaske, "Head-related Two-channel Stereophony with Reproduction," J. Acoust. Soc. Am. 50, 1109-1115 (1971).

[6]H. Hamada, N. Ikeshoji, Y. Ogura And T. Miura, "Relation between Physical Characteristics of Orthostereophonic System and Horizontal Plane Localisation," Journal of the Acoustical Society of Japan, (E) 6, 143-154, (1985).

[7] J. L. Bauck and D. H. Cooper, "Generalized Transaural Stereo and Applications," J. Acoust. Soc. Am. 44 (9), 683-705 (1996).

[8] P. A. Nelson, O. Kirkeby, T. Takeuchi, and H. Hamada, "Sound fields for the production of virtual acoustic images," J. Sound. Vib. 204 (2), 386-396 (1997).

[9] M. Miyoshi and N. Koizumi, "New transaural system for teleconferencing service". Proceedings of the International Symposium on Active Control of Sound and Vibration, Acoustical Society of Japan, Apr. 9-11, (1991), Nippon-Toshi-Center, Tokyo, Japan. Pages 217-222.

[10] M. Miyoshi and Y. Kaneda, "Inverse filtering of room acoustics" IEEE Transactions on Acoustics Speech and Signal Processing 36, 145-152 (1988).

[11] S. Uto, H. Hamada, T. Miura, P. A. Nelson and S. J. Elliott, Proceedings of the International Symposium on Active Control of Sound and Vibration, Acoustical Society of Japan, Apr. 9-11, (1991), Nippon-Toshi-Center, Tokyo, Japan. Pages 421-426.

[12] D. H. Cooper and J. L. Bauck, "Head diffraction compensated stereo system with loudspeaker array" U.S. Pat. No. 5,333,200 (1994).

[13] T. Takeuchi and P. A. Nelson, "Optimal source distribution for binaural synthesis over loudspeakers", J. Acoust. Soc. Am. 112, 2786 (2002).

[14] P. A. Nelson, F. Orduna-Bustamante, and H. Hamada, "Inverse Filter Design and Equalisation Zones in Multi-Channel Sound Reproduction," IEEE Trans. Speech Audio Process. 3(3), 185-192 (1995).

[15] O. Kirkeby, P. A. Nelson, F. Orduna-Bustamante, and H. Hamada, "Local Sound Field Reproduction Using Digital Signal Processing," J. Acoust. Soc. Am. 100, 1584-1593 (1996).

[16] E. M. Wenzel, M. Arruda, D. J. Kistler and F. L. Wightman, "Localisation using nonindividualized head-related transfer functions," J. Acoust. Soc. Am. 94(1), 111-123 (1993).

[17]H. Møller, M. F. Sørensen, D. Hammershøi, and C. B. Jensen, "Head-Related Transfer Functions on Human Subjects," J. Audio Eng. Soc., 43, 300-321 (1995).

[18] T. Takeuchi, P. A. Nelson, O. Kirkeby and H. Hamada, "Influence of Individual Head Related Transfer Function on the Performance of Virtual Acoustic Imaging Systems", 104th AES Convention Preprint 4700 (P4-3), (1998).

[19] T. Takeuchi, P. A. Nelson, and H. Hamada, "Robustness to Head Misalignment of Virtual Sound Imaging Systems," J. Acoust. Soc. Am. 109(3), 958-971 (2001).

[20] W. H. Press, S. A. Teukolsky, W. T. Vetterling, and B. P. Flannery, "Numerical Recipes in C, Second edition," (Cambridge University Press, 1992).

[21] T. Takeuchi, P. A. Nelson, O. Kirkeby and H. Hamada, "The Effects of Reflections on the Performance of Virtual Acoustic Imaging Systems", pp. 955-966, in Proceedings of the Active 97, The international symposium on active control of sound and vibration, Budapest, Hungary, Aug. 21-23, (1997), OPAKFI.

[22] S. J. Elliot, C. C. Boucher, and P. A. Nelson, "The Behavior of a Multiple Channel Active Control System," IEEE Trans. Signal Process 40(5), (1992).

[23] D. J. Rossetti, M. R. Jolly, and S. C. Southward, "Control Effort Weighting in Feedforward Adaptive Control Systems," J. Acoust. Soc. Am. 99(5), (1996).

The invention claimed is:

1. A sound reproduction system comprising:

an electro-acoustic transducer; and a transducer drive for driving the electro-acoustic transducer in response to an input sound recording, the transducer drive comprising a filter which is configured to reproduce at a listener location an approximation to the local sound field that would be present at a listener's ears in recording space, taking into account characteristics and an intended position of the electro-acoustic transducer relative to the ears of the listener, the electro-acoustic transducer comprising a central sound emitter which provides a central sound emission channel, a left sound emitter which provides a left sound emission channel and a right sound emitter which provides a right sound emission channel, the central sound emitter being located intermediate of left sound emitter and the right sound emitter, the central sound emitter, the left sound emitter and the right sound emitter each arranged to emit a range of frequencies, and both of the left sound emitter and the right sound emitter being such that different frequencies of the range are emitted from different respective azimuthal positions in a frequency distributed arrangement wherein predominantly higher frequencies of the range are transmitted closer to the central sound emitter and predominantly lower frequencies of the range are transmitted away from the central sound emitter, and the central sound emitter arranged to emit said range of frequencies emitted by one or both of the left sound emission channel and the right sound emission channel from substantially a single azimuthal location, as opposed to the frequency distributed arrangement of both of said left sound emission channel and said right sound emission channel.

2. The sound reproduction system as claimed in claim 1 in which at least one of the left sound emitter and the right sound emitter is positioned over a respective azimuthal span or region, and portions of at least one of (i) the left sound emitter and (ii) the right sound emitter having different azimuth directions emit predominantly different frequencies of sound, or predominantly different ranges of frequencies of sound.

3. The sound reproduction system as claimed in claim 1 in which at least one of the left sound emitter and the right sound emitter comprises a plurality of different positioned sound emitter devices, and in use each sound emitter device emitting a respective predominant frequency or a predominant range of frequencies of sound.

4. The sound reproduction system as claimed in claim 1 in which the central sound emitter is provided substantially central of the left sound emitter and the right sound emitter.

5. The sound reproduction system as claimed in claim 1 in which the central sound emitter is located rearwardly of the left sound emitter and the right sound emitter.

6. The sound reproduction system as claimed in claim 1 in which the central sound emitter provides a substantially non-variable frequency output with respect to the spatial extent of the central sound emitter, wherein the frequency substantially does not vary with azimuthal position and a range of frequencies is configured to be emitted therefrom.

7. The sound reproduction system as claimed in claim 1 in which one of the left sound emitter and the right sound emitter provides a substantially non-variable frequency output with respect to the spatial extent of the left sound emitter and the right sound emitter, wherein the frequency substantially does not vary with azimuthal position and a range of frequencies is configured to be emitted therefrom.

8. The sound reproduction system as claimed in claim 1 in which the head related transfer functions of a listener are taken into account.

9. The sound reproduction system as claimed in claim 1 in which the operational transducer frequency/azimuth range is determined by an equation of the form $$f = \frac{nc_0}{4\Delta r \sin(\theta_L)}$$

-continued or $$f = \frac{nc_0}{4\Delta r \sin(\theta_R)}$$

where the transducer azimuth angle $\theta_L$, $\theta_R$, are the angles subtended at the listener by the central sound emitter, the left sound emitter and the right sound emitter, respectively, where $$0<n<4,$$

f: is the frequency, $c_0$: is the speed of sound, and $\Delta r$: is the equivalent distance between the ears.

10. The sound reproduction system as claimed in claim 9 where $0<n<3.9$.

11. A sound reproduction system as claimed in claim 9 where $0<n<3.7$.

12. The sound reproduction system as claimed in claim 9 where $0.1<n<3.9$.

13. The sound reproduction system as claimed in claim 9 where $0.3<n<3.7$.

14. The sound reproduction system as claimed in claim 1 in which the transducer drive comprises cross-over filters for distributing signals of the appropriate frequency range to the appropriate sets of sound emitters, the cross-over filters responding to the outputs of an inverse filter of said filter.

15. The sound reproduction system as claimed in claim 1 in which the transducer drive comprises cross-over filters for distributing signals of the appropriate frequency range to the appropriate sets of sound emitters, with an inverse filter of said filter being responsive to the outputs of the cross-over filters.

16. The sound reproduction system as claimed in claim 1, in which the filter may be configured to be a minimum norm solution of the inverse problem.

17. The sound reproduction system as claimed in claim 1, in which the filter is configured to be a pseudoinverse filter.

18. The sound reproduction system as claimed in claim 1, in which the filter is configured to comprise adaptive filters.

19. The sound reproduction system as claimed in claim 1 comprising sub-woofers for responding to very low audio frequencies.

20. The sound reproduction system as claimed in claim 1, in which the number of sound emitter devices for the central sound emitter, the left sound emitter, and the right sound emitter comprise a different number of sound emitter devices to each other.

21. The sound reproduction system as claimed in claim 1, in which the central sound emitter comprises a single sound emitter device without any cross-over filters.

22. The sound reproduction system as claimed in claim 1 comprising a conventional loudspeaker for reproducing sound in a conventional method.

* * * * *